US009581959B2

(12) United States Patent
Shirayanagi

(10) Patent No.: US 9,581,959 B2
(45) Date of Patent: Feb. 28, 2017

(54) PROCESS CARTRIDGE

(75) Inventor: Jun Shirayanagi, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 124 days.

(21) Appl. No.: 13/167,151

(22) Filed: Jun. 23, 2011

(65) Prior Publication Data

US 2011/0318052 A1 Dec. 29, 2011

(30) Foreign Application Priority Data

Jun. 28, 2010 (JP) ..... 2010-146198

(51) Int. Cl.
*G03G 21/18* (2006.01)
*G03G 15/08* (2006.01)

(52) U.S. Cl.
CPC ..... *G03G 21/1842* (2013.01); *G03G 15/0881* (2013.01); *G03G 21/1857* (2013.01); *G03G 2221/1648* (2013.01)

(58) Field of Classification Search
CPC ..... G03G 2221/183; G03G 15/0894; G03G 15/0898; G03G 2221/1648
USPC .. 399/111, 113, 114, 91, 102, 103, 105, 106
See application file for complete search history.

(56) References Cited

U.S. PATENT DOCUMENTS

| | | | | |
|---|---|---|---|---|
| 6,343,192 | B1 * | 1/2002 | Miyabe et al. | 399/13 |
| 7,630,661 | B2 * | 12/2009 | Noda et al. | 399/67 |
| 7,783,227 | B2 * | 8/2010 | Sugimoto | 399/111 |
| 2007/0041747 | A1 * | 2/2007 | Kim et al. | 399/222 |

FOREIGN PATENT DOCUMENTS

| | | | | |
|---|---|---|---|---|
| JP | 02-166470 | | 6/1990 | |
| JP | 06-051576 | | 2/1994 | |
| JP | 6-33154 | | 4/1994 | |
| JP | 10-171331 | | 6/1998 | |
| JP | 2002-62735 | A | 2/2002 | |
| JP | 2004-109192 | A | 4/2004 | |
| JP | 2008-129090 | | 6/2008 | |
| JP | 2008-129090 | A | 6/2008 | |
| JP | 2008129090 | A * | 6/2008 | ..... G03G 15/00 |

OTHER PUBLICATIONS

Office Action in Japanese Patent Application No. 2010-146198, mailed Mar. 18, 2014 (with partial English translation).

* cited by examiner

*Primary Examiner* — David Gray
*Assistant Examiner* — Carla Therrien
(74) *Attorney, Agent, or Firm* — Fitzpatrick, Cella, Harper & Scinto

(57) ABSTRACT

A process cartridge detachably mountable to a main assembly of an image forming apparatus includes an image bearing member; a developer carrying member for developing an electrostatic image on the image bearing member; a first gear provided on the developer carrying member and a second gear driving-connected to the first gear; and a supporting portion for rotatably supporting the second gear. The supporting member is mounted on a frame of the process cartridge through a vibration damping member having a vibration transmission performance lower than that of at least the supporting portion.

58 Claims, 11 Drawing Sheets

(a)

(b)

(a)

(b)

(a)

(b)

PROCESS CARTRIDGE

FIELD OF THE INVENTION AND RELATED ART

The present invention relates to a process cartridge including a developing device in which a developer carrying member and a developer stirring member are interrelated with a gear mechanism provided at a longitudinal end portion. Specifically, the present invention relates to a structure for damping vibration of an image bearing member due to vibration generated by the gear mechanism.

An image forming apparatus in which an electrostatic image formed on the image bearing member is developed into a toner image and the toner image is transferred onto a recording material directly or via an intermediary transfer member and then is heat-fixed has been widely used.

In the developing device, the developer carrying member (developing sleeve or developing roller) and a plurality of developer stirring members (feeding screw and stirring blade) and disposed side by said with respect to a longitudinal direction. These members are connected at an outside of a developing container by using a gear mechanism.

Further, in a process cartridge in which the developing device is incorporated, in some cases, a driving force to be transmitted to the image, bearing member (photosensitive drum), a charging member (charging roller), a cleaning member (for brush) and the like is distributed by using the same gear mechanism.

With respect to the developing device or process cartridge in which the developer carrying member and the developer stirring (feeding) member are integrally interrelated with each other by the gear mechanism, vibration generated by the gear mechanism with an operation of the developing device is problematic. Vibration of various frequency components generated by variation in engagement of the gear mechanism produces resonance to vibrate the image bearing member, so that pitch non-uniformity of image scanning lines occur. This is problematic and therefore a structure for dampering the vibration is incorporated in the gear mechanism.

Further, when the vibration of the developing device is transmitted to a casing structure of the image forming apparatus, the vibration is transmitted to a laser beam exposure device through the casing structure, so that the pitch non-uniformity of the scanning lines is amplified several tens of times through an optical system. For this reason, countermeasures such that a vibration damping material is interposed at a mounting position of the developing device and that rigidity of the casing structure is enhanced have been employed.

In a process cartridge described in Japanese Laid-Open Patent Application (JP-A) Hei 06-051576, the vibration of the image bearing member is damped by providing a gear mechanism for rotating the image bearing member independently of a gear mechanism for interrelating the developer carrying member and the developer feeding member.

In a process cartridge described in JP-A Hei 10-171331, the vibration of the image bearing member is damped by independently providing gear mechanisms for transmitting a driving force to a charging device, a developing device and a cleaning device.

JP-A 2008-129090 discloses that a side plate for supporting a driving unit is formed in a low-rigidity portion in order to suppress transmission of vibration of the driving unit, to a main assembly side, for driving the image bearing member and the developer carrying member.

However, in the constitutions of JP-A Hei 06-051576 and JP-A Hei 10-171331, the vibration generated from the gear mechanism itself is transmitted to a frame as it is, so that the pitch non-uniformity of the image scanning lines occurs. Further, in the constitution of the process cartridge in JP-A 2008-129090, the vibration of the driving unit in which a driving source and driving gear train provided at a main assembly side of the image forming apparatus are integrally assembled can be less transmitted to the main assembly. However, in the case of a cartridge detachably mountable to the main assembly, the vibration of the cartridge itself into which the driving force is inputted from the main assembly-side driving source cannot be suppressed.

In recent years, with an increase in process speed of the image forming apparatus, there is a tendency to increase a frequency of the vibration of the gear mechanism generated in the developing device to increase an amplitude of the vibration. On the other hand, as a result of downsizing of the image forming apparatus, it is difficult to enhance rigidity of the casing structure and vibration transmission among components, such as the exposure device, incorporated in the casing structure is liable to occur. Further, in the case where the laser beam exposure device is employed, when the exposure device is downsized, a length of optical path becomes long, so that a proportion of the influence of the vibration of the exposure device on the image becomes high.

Therefore, when the pitch non-uniformity of the image scanning lines formed on the recording material is measured and statistically processed, it was found that the scanning line pitch non-uniformity which coincides with a vibration period of the gear mechanism of the developing device largely affects an image quality.

SUMMARY OF THE INVENTION

A principal object of the present invention is to provide a process cartridge, in which an image bearing member and a developing device are integrally assembled, capable of suppressing vibration of the image bearing member due to vibration generated from a drive transmission mechanism provided in the process cartridge.

According to an aspect of the present invention, there is provided a process cartridge detachably mountable to a main assembly of an image forming apparatus, comprising:

an image bearing member;

a developer carrying member for developing an electrostatic image on the image bearing member;

a first gear provided on the developer carrying member and a second gear driving-connected to the first gear; and a supporting portion for rotatably supporting the second gear, wherein the supporting member is mounted on a frame of the process cartridge through a vibration damping member having a vibration transmission performance lower than that of at least the supporting portion.

These and other objects, features and advantages of the present invention will become more apparent upon a consideration of the following description of the preferred embodiments of the present invention taken in conjunction with the accompanying drawings.

Figure 5:
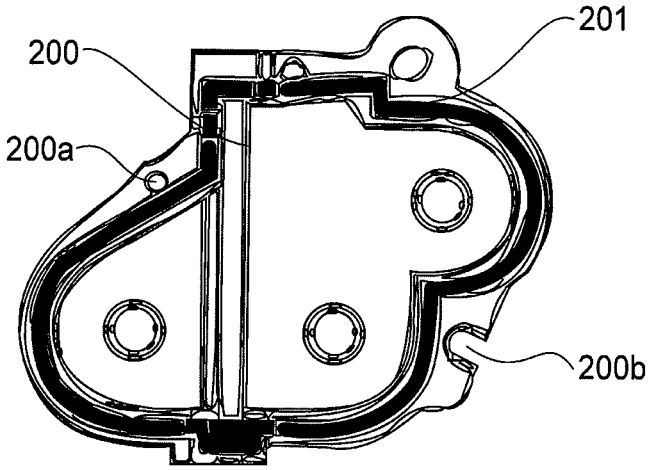
Figure 5:
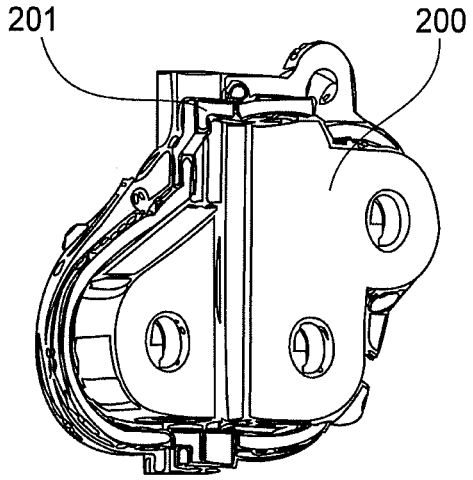

Parts (a) and (b) of FIG. 5 are illustrations of a side member in Embodiment 1.

Figure 6:
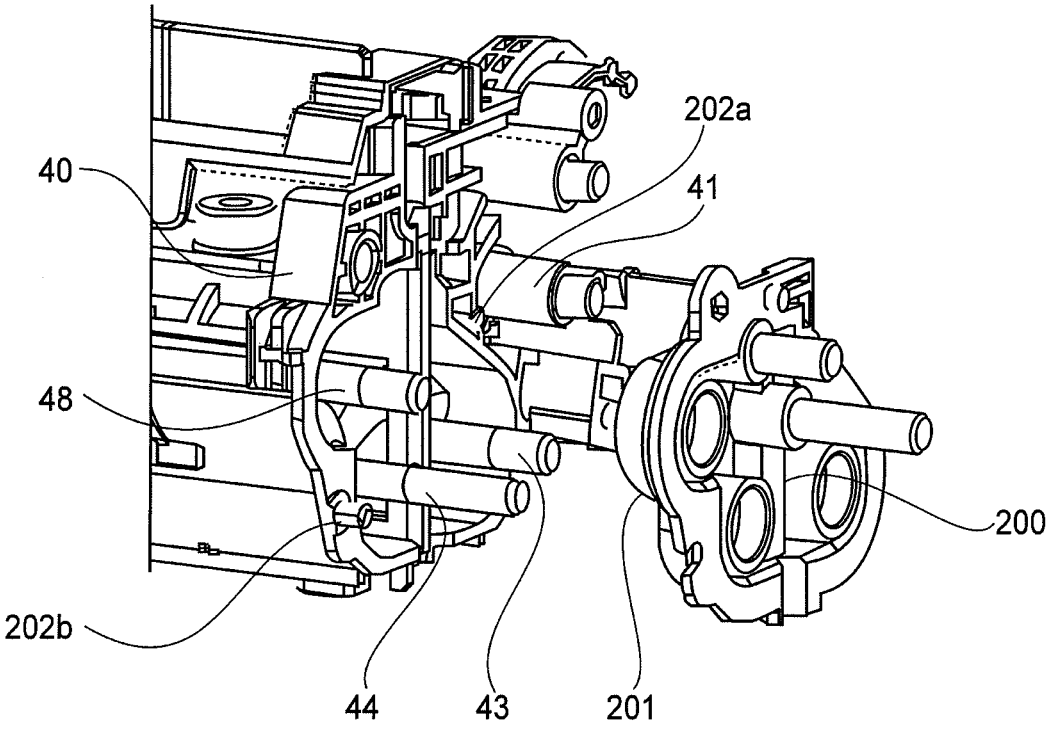

FIG. 6 is an illustration of an assembling structure of the side member in Embodiment 1.

Figure 7:
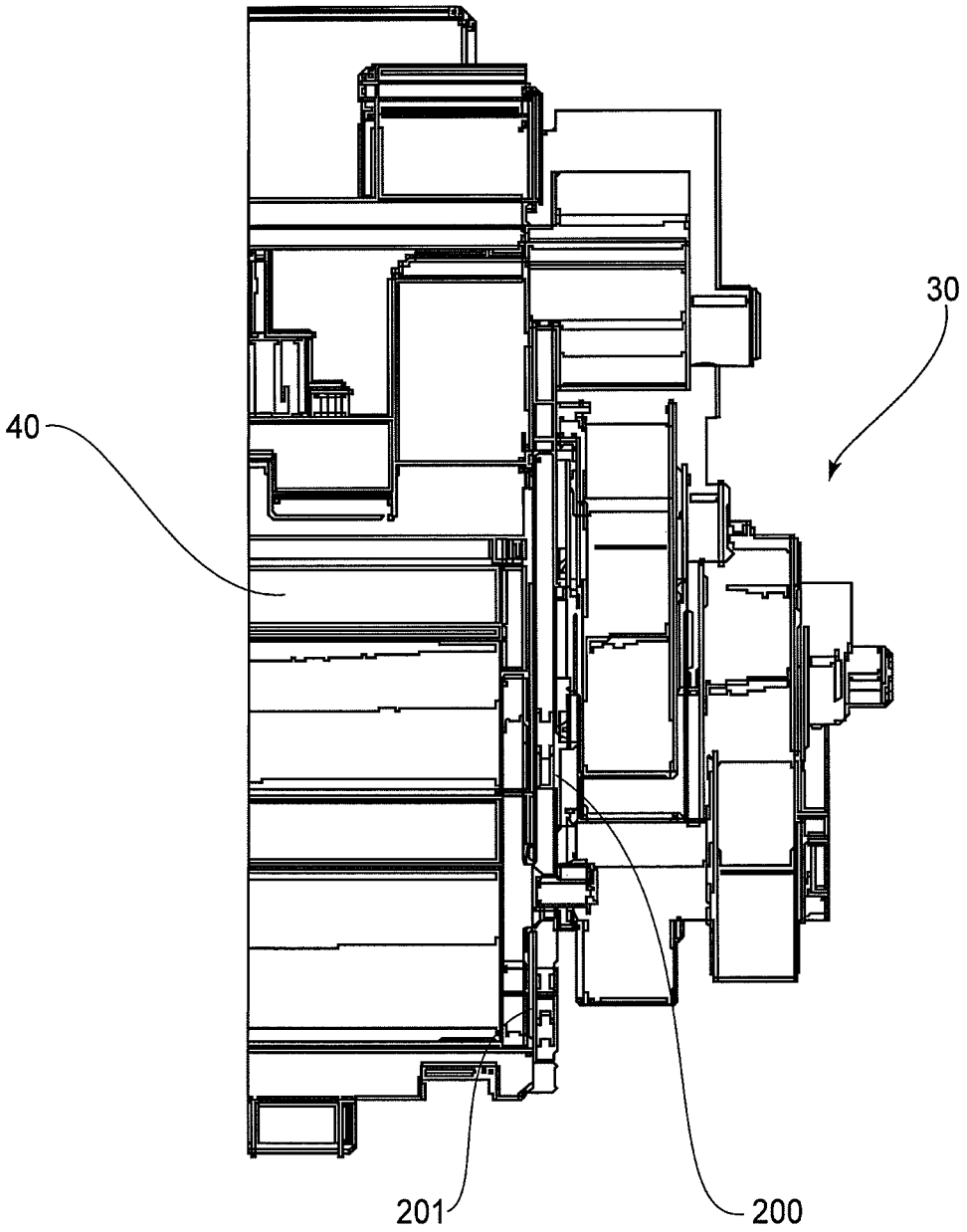

FIG. 7 is an illustration of a gear structure.

Figure 8:
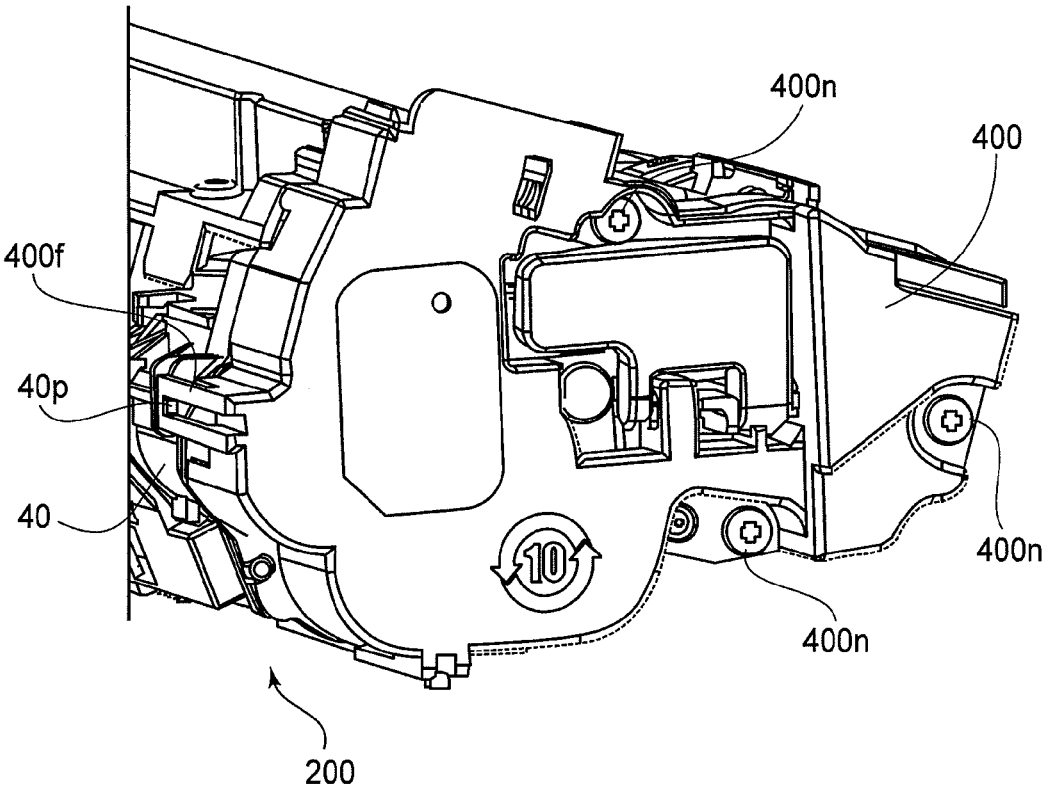

FIG. 8 is an illustration of a mounted structure of a front cover.

Figure 9:
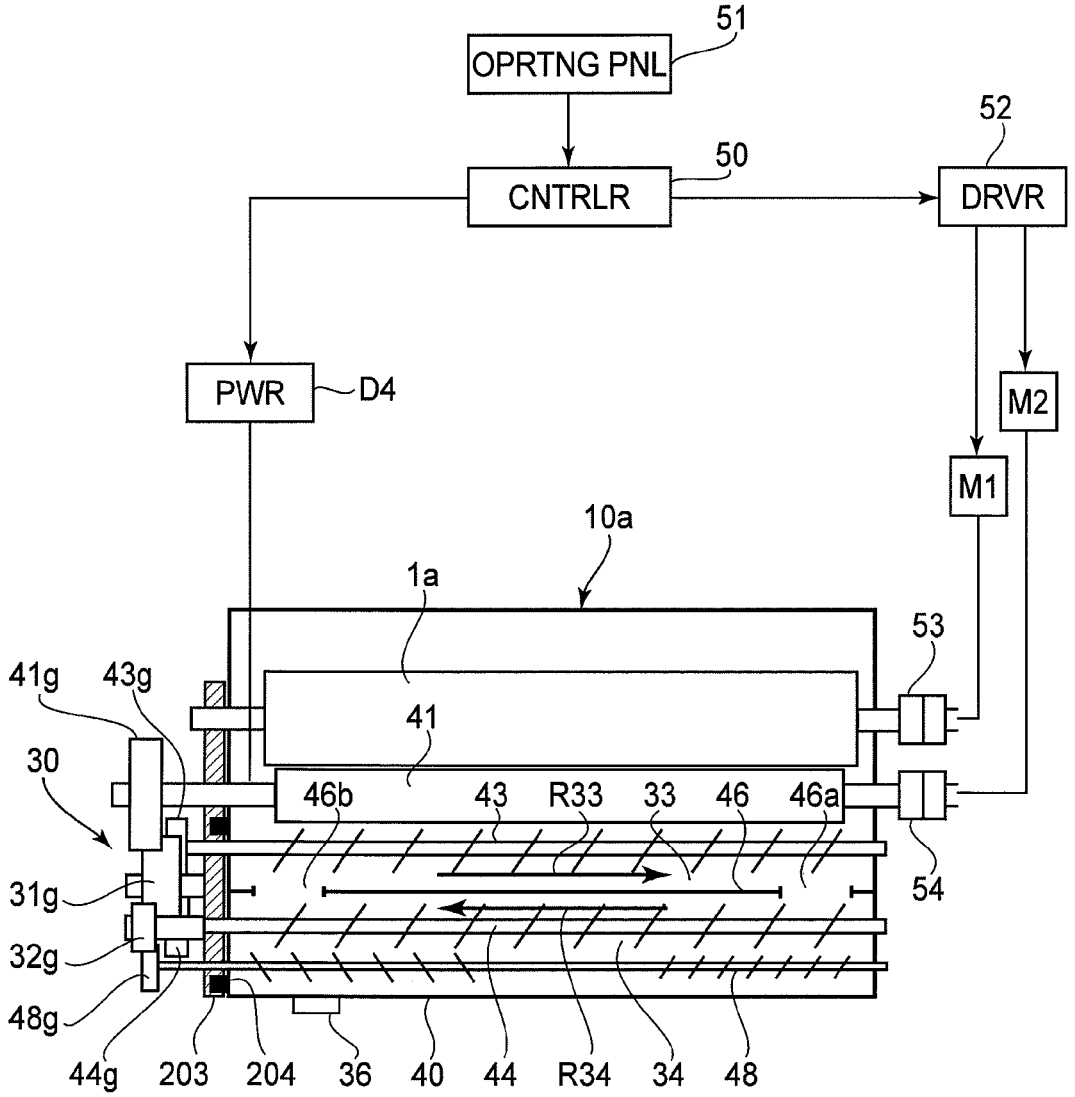

FIG. 9 is an illustration of a planar structure of a developing device in Embodiment 2.

Figure 10:
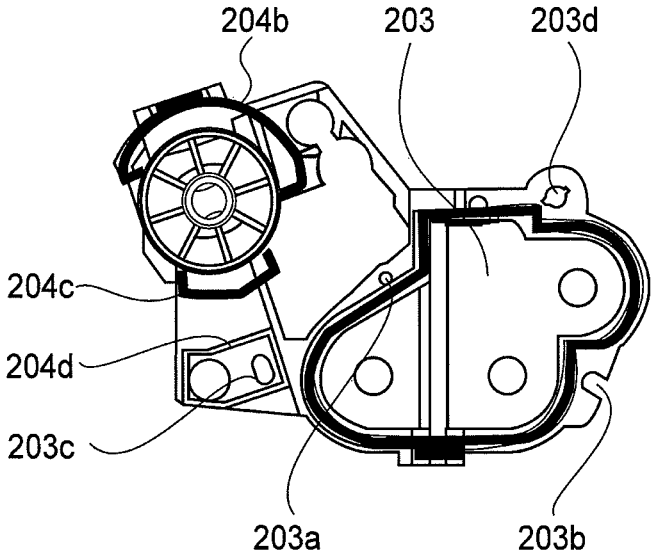
Figure 10:
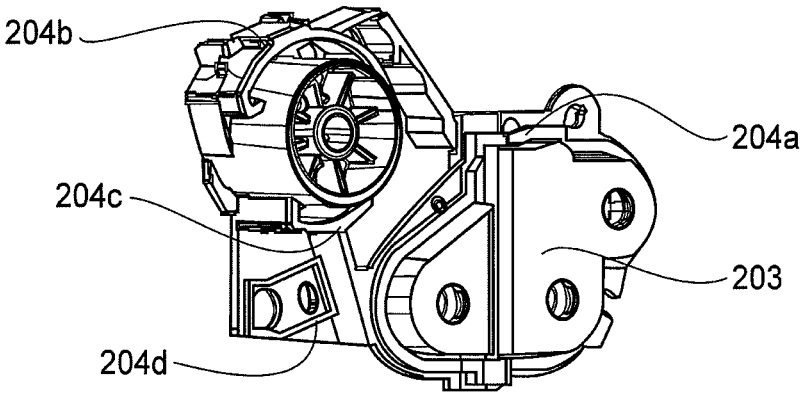

Parts (a) and (b) of FIG. 10 are illustrations of a side member in Embodiment 2.

Figure 11:
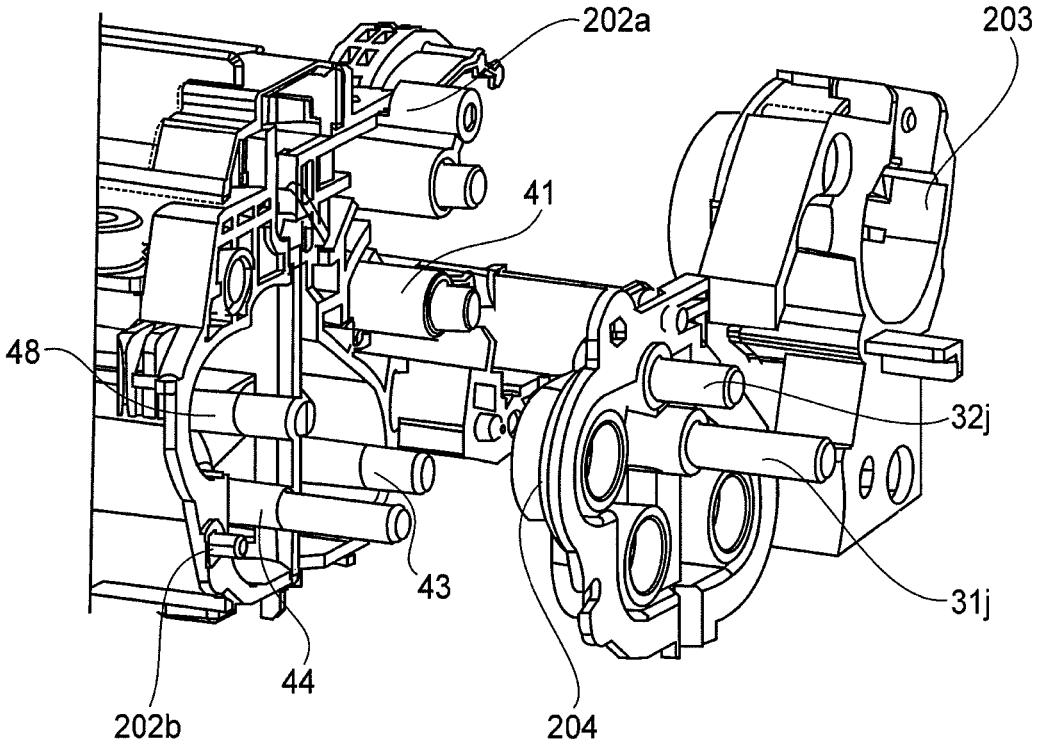

FIG. 11 is an illustration of an assembling structure of the side member in Embodiment 2.

Figure 12:
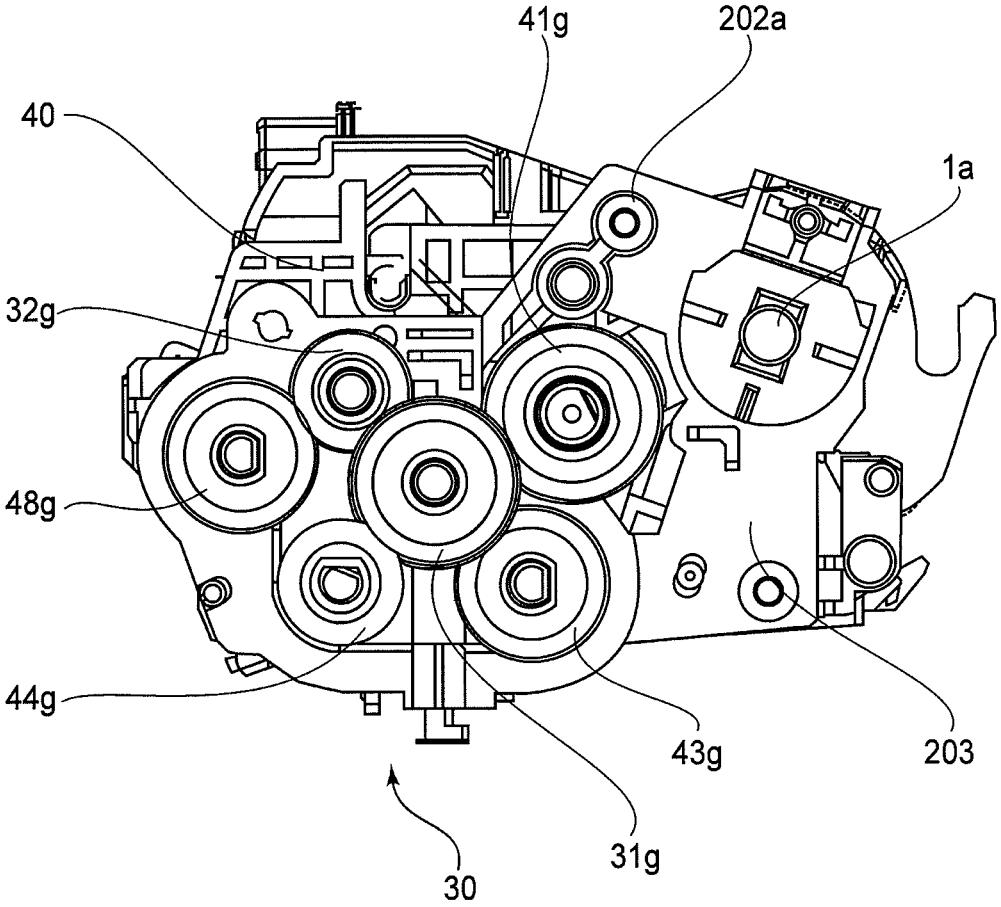

FIG. 12 is an illustration of a planar arrangement of a gear structure.

DESCRIPTION OF THE PREFERRED EMBODIMENTS

Embodiments of the present invention will be described with reference to the drawings. The present invention is also applicable to other embodiments in which a part or all of constituents are replaced with their alternative constituents so long as a supporting member for supporting a gear mechanism is mounted on a developing container through a rubber material.

Therefore, the present invention can be carried out in various image forming apparatuses irrespective of types including a full-color/monochromatic type, a charging system, a laser beam exposure/LED array exposure type, a transfer system, a tandem/one-drum type, and an intermediary transfer/recording material conveyance/direct transfer type.

In this embodiment, only a principal portion relating to toner image formation and transfer will be described but the present invention can be carried out in image forming apparatuses, for various purposes, such as printers, printing machines, copying machines, facsimile machines and multifunction, machines by adding necessary equipment, device and casing structure.

Incidentally, general matters of image forming apparatuses, developing devices and process cartridges described in JP-A Hei 06-051576 and JP-A Hei 10-171331 will be omitted from illustration and redundant description.

<Image Forming Apparatus>

Figure 1:
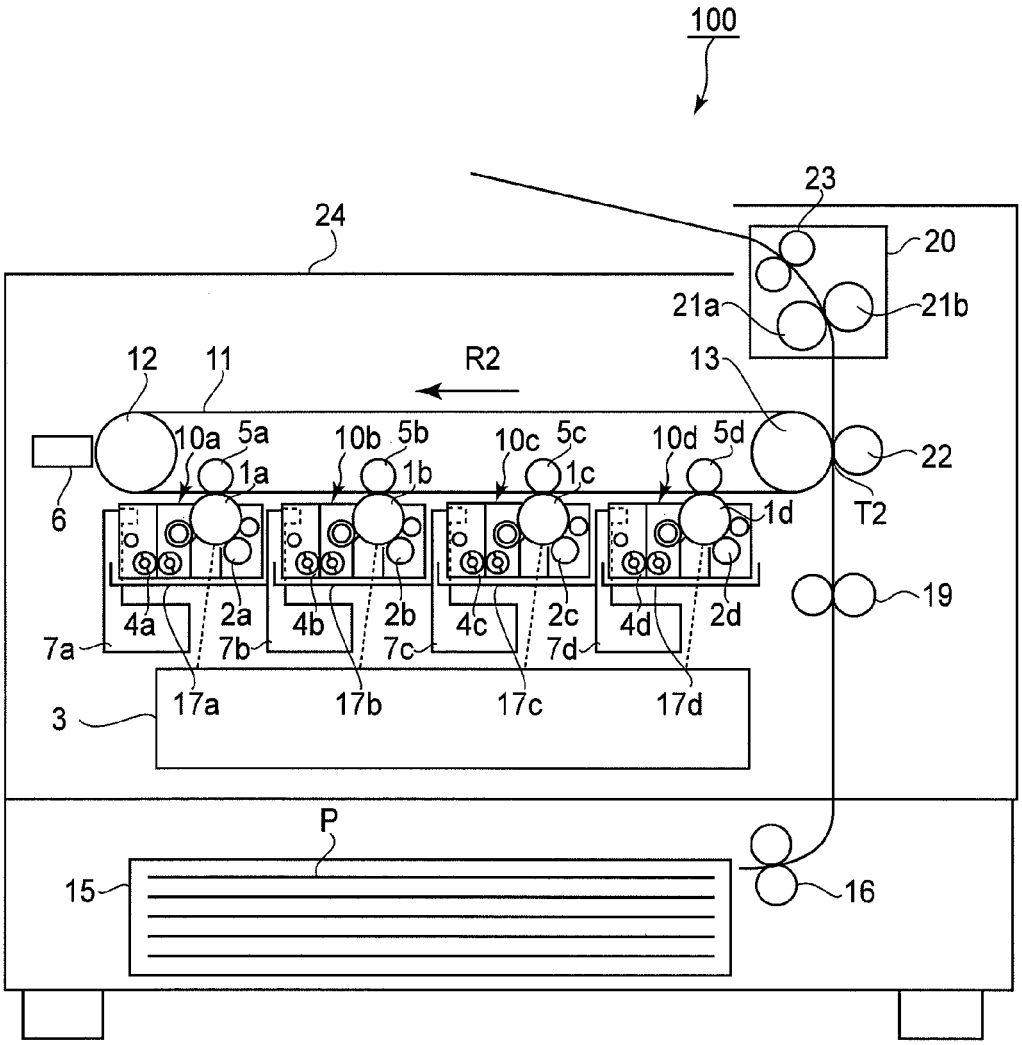
FIG. 1 is an illustration of a structure of an image forming apparatus.

FIG. 1 is an illustration of a structure of an image forming apparatus. As shown in FIG. 1, an image forming apparatus 100 is a tandem type full-color printer of an intermediary transfer type in which process cartridges 10*a* for yellow, 10*b* for magenta, 10*c* for cyan and 10*d* for black are juxtaposed along an intermediary transfer belt 11.

In the process cartridge 10*a*, a yellow toner image is formed on a photosensitive drum 1*a* and then is transferred onto the intermediary transfer belt 11. In the process cartridge 10*b*, a magenta toner image is formed on a photosensitive drum 1*b* and then is transferred onto the intermediary transfer belt 11. In the process cartridges 10*c* and 10*d*; a cyan toner image and a black toner image are formed on photosensitive drums 1*c* and 1*d*, respectively, and then are transferred onto the intermediary transfer belt 11.

The four color toner images transferred onto the intermediary transfer belt 11 are conveyed to a secondary transfer portion T2, where the toner images are secondary-transferred onto a recording material P. The recording material P picked out from a recording material cassette 15 is separated one by one by a separation roller 16 and is fed to a registration roller 19. The registration roller 19 sends the recording material P to the secondary transfer portion T2 while timing the recording material P to the toner images on the intermediary transfer belt 11. The recording material P onto which the toner images are transferred from the intermediary transfer belt 11 are heated and pressed by a fixing device 20, so that the toner images are fixed on the recording material P. Therefore, the recording material P is discharged to an outside 24 of the image forming apparatus 100.

The process cartridges 10*a*, 10*b*, 10*c* and 10*d* are individually detachably mountable to an apparatus main assembly of the image forming apparatus 100 by being extracted from and inserted into the apparatus main assembly from a front side of the image forming apparatus 100. The process cartridges 10*a*, 10*b*, 10*c* and 10*d* have the substantially same constitution except that the colors of toners used in developing devices 4*a*, 4*b*, 4*c* and 4*d* are different from each other. In the following description, the process cartridge 10*a* will be explained. With respect to other process cartridges 10*b*, 10*c* and 10*d*, respectively constituent elements should be construed by reading the suffix a of corresponding constituent elements of the process cartridge 10*a* as b, c and d, respectively.

The process cartridge 10*a* includes the photosensitive drum 1*a*, a charging roller 2*a* and the developing device 4*a*. Around the photosensitive drum 1*a*, in the order that an image forming process is performed, the charging roller 2*a*, an exposure device 3, the developing device 4*a*, a primary transfer roller 5*a*, and deck brush and fur brush which are used for effecting simultaneous development and cleaning are disposed. The process cartridge 10*a* is prepared by integrally assembling the photosensitive drum 1*a*, the charging roller 2*a*, the developing device 4*a* and the cleaning device into a cartridge.

The photosensitive drum 1*a* is prepared by applying an organic photoconductor (OPC) photosensitive member onto an outer peripheral surface of an aluminum cylinder of 30 mm in diameter. The photosensitive drum 1*a* is rotatably supported at longitudinal end portions. To one end portion of the photosensitive drum 1*a*, a driving force is transmitted, so that the photosensitive drum 1*a* is rotated at a predetermined process speed. The charging roller 2*a* is rotated by the photosensitive drum 1*a* in contact to the surface of the photosensitive drum 1*a*. By applying to the charging roller 2*a* an oscillating voltage of DC voltage biased with an AC voltage, the surface of the photosensitive drum 1*a* is electrically charged to a uniform dark-portion potential VD.

The exposure device 3 scans the surface of the photosensitive drum 1*a*, through a rotation mirror, with a laser beam binary-modulated depending on an image signal to lower a potential of the photosensitive drum 1*a* at an exposed portion to a light-portion portion VL, thus writing (forming) an electrostatic image. The developing device 4*a* deposits the toner on the exposed portion of the photosensitive drum 1*a*, thus developing the electrostatic image into a toner image on the photosensitive drum 1*a*. A toner supplying device 7*a* supplies a developer consumed with image formation to the developing device 4*a*.

The intermediary transfer belt 11 are extended and supported by a driving roller 13, which also functions as an opposite roller, and a tension roller 12 and is rotated in an arrow R2 direction at a predetermined process speed. The intermediary transfer belt 11 is constituted by a film-like member.

The primary transfer roller 5*a* presses an inner surface of the intermediary transfer belt 11 toward the photosensitive drum 1*a* to form a primary transfer position between the intermediary transfer belt 11 and the photosensitive drum 1*a*. A secondary transfer roller 22 contacts the intermediary transfer belt 11 surfaced from the inside by the opposite roller 13 to form the secondary transfer portion T2.

By applying a DC voltage of a positive polarity to the primary transfer roller 5*a*, a negatively charged toner image carried on the photosensitive drum 1*a* is primary-transferred onto the intermediary transfer belt 11. By applying a DC voltage of the positive polarity to the secondary transfer roller 22, the toner images carried on the intermediary transfer belt 11 are secondary-transferred onto the recording material P passing through the secondary transfer portion T2 on the intermediary transfer belt 11.

A charging member provided downstream of the primary transfer portion negatively charges transfer residual toner, which is positively charged and passes through the primary transfer portion, while dispersing the transfer residual toner on the surface of the intermediary transfer belt 11. The negatively charged toner is used again in the developing device 4*a*, so that the simultaneous development and cleaning is effected.

In the fixing device 20, a pressing roller 21*b* is press-contacted to a heating roller 21*a* which is internally heated to form a heating nip therebetween. In the heating nip, the recording material P is nip-conveyed and is subjected to application of heat and pressure, so that the toner image is heat-fixed on the surface of the recording material P.

<Developing Device>

Figure 2:
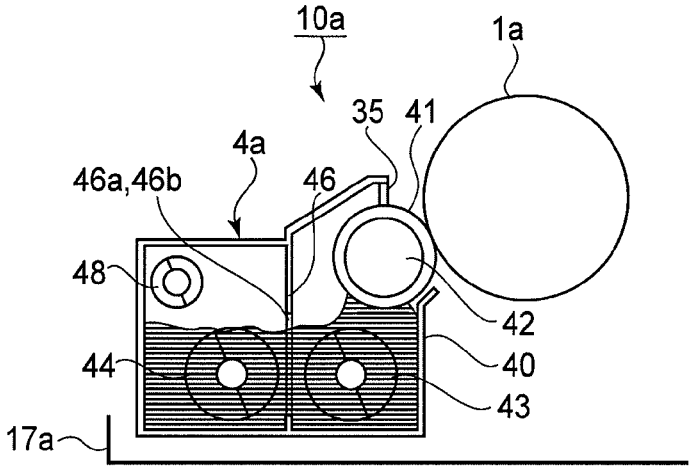
FIG. 2 is an illustration of a structure of a developing device at a cross section perpendicular to a longitudinal direction of the developing device.
Figure 4:
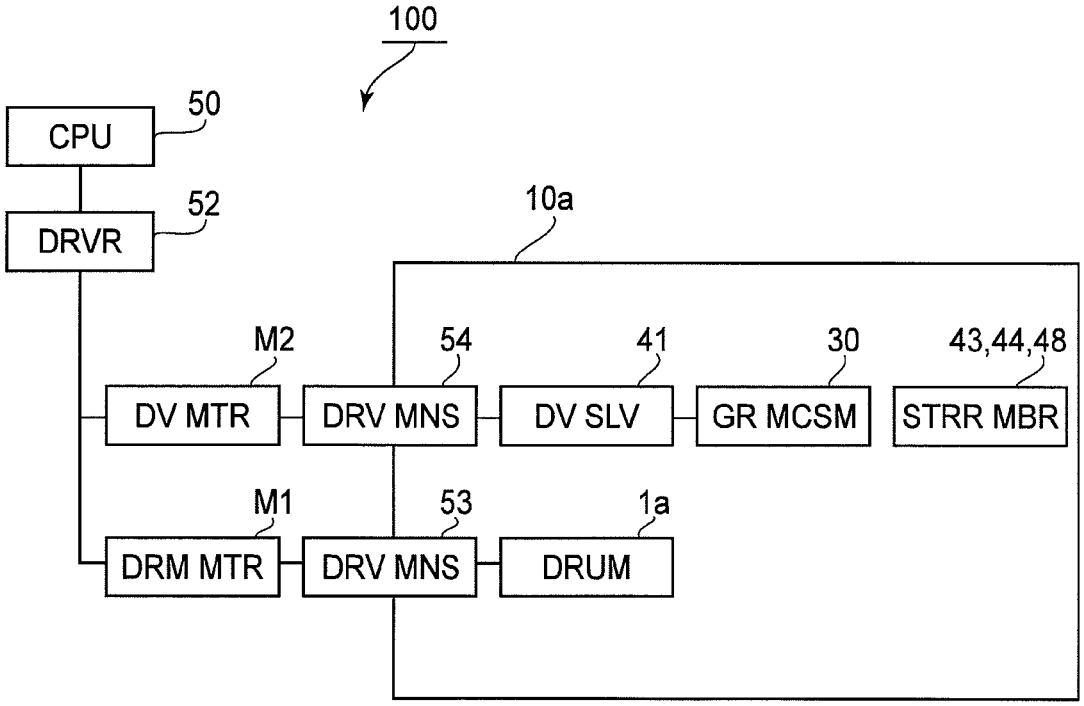
FIG. 4 is a block diagram of a driving system of a process cartridge.
Figure 3:
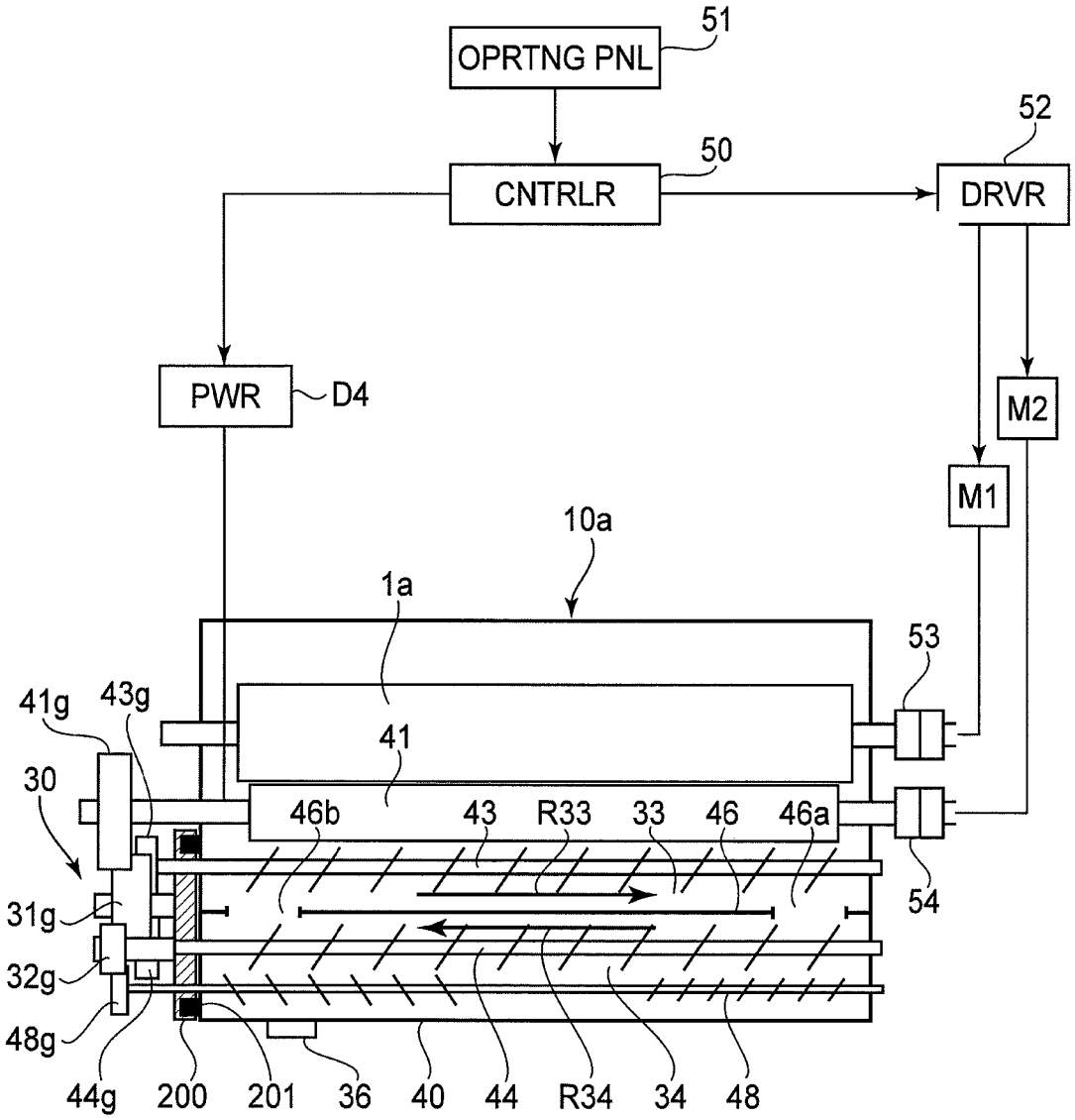
FIG. 3 is an illustration of a planar structure of the developing device.

FIG. 2 is an illustration of a structure of the developing device at a cross section perpendicular to a longitudinal direction. FIG. 3 is an illustration of a planar structure of the developing device. FIG. 4 is a block diagram of a driving system of the process cartridge.

As shown in FIG. 2, the process cartridge 10*a* includes a developing sleeve 41, which is an example of the developer carrying member, on which the developer containing the toner and a carrier is carried, and develops the electrostatic image on the photosensitive drum 1*a* with the developer.

In the developing device 4*a*, a two-component developer in which the toner (magnetic) and the carrier (non-magnetic) are mixed is stirred to triboelectrically charge the toner and the carrier to the negative polarity and the positive polarity, respectively.

The developing sleeve 41 rotates about a fixed magnet 42 at the center thereof and a magnetic force of the fixed magnet 42 attracts the carrier at the surface of the developing sleeve 41, so that the two-component developer is coated on the surface of the developing sleeve 41. The two-component developer coated on the surface of the developing sleeve 41 is regulated in its layer thickness by a layer thickness-regulating blade 35 and then is conveyed to an opposing portion where the developing sleeve 41 opposes the photosensitive drum 1*a*, so that a magnetic brush is formed so as to rub the surface of the photosensitive drum 1*a*.

An oscillating voltage in the form of a negative DC voltage biased with an AC voltage is applied from a voltage source (D4: FIG. 3) to the developing sleeve 41, so that the toner is transferred onto the electrostatic image on the photosensitive drum 1*a* which is positive relative to the developing sleeve 41 and thus the electrostatic image is developed.

The toner is transferred onto the photosensitive drum 1*a* with the development of the electrostatic image, while the carrier is moved back into a developing chamber 33 and is continuously circulated in the developing container 40. For this reason, an amount of the toner in the two-component developer is decreased with cumulative image formation and therefore the toner supplying device 7*a* supplies the developer (toner) to the developing device 4*a* during image formation.

As shown in FIG. 3, the developing sleeve 41 which is an example of the developer carrying member develops the electrostatic image on the photosensitive drum 1*a* which is an example of the image bearing member. The developing container 40 accommodates the developer to be carried on the developing sleeve 41. A developing screw 43 and a stirring screw 44 which are examples of the developer stirring member are disposed in parallel to the developing sleeve 41 in the developing container 40.

The developing container 40 is partitioned into a developing chamber 33 and a stirring chamber 34 by a longitudinal partition wall. The stirring chamber 34 extends in the longitudinal direction in parallel to the developing chamber 33 and communicates with the developing chamber 33 through openings 46*a* and 46*b* formed at longitudinal end portions of the partition wall 46. The developing screw 43 supplies the developer in the developing chamber 33 to the developing sleeve 41 while feeding the developer in an arrow 33 direction. The stirring screw 44 feeds the developer in the stirring chamber 34 in an arrow 34 direction opposite to the arrow 33 direction for the developing screw 43, thus circulating the developer between the stirring chamber 34 and the developing chamber 33.

In the neighborhood of the opening 46*b* through which the developer is transferred from the stirring chamber 34 to the developing chamber 33, a toner content (concentration) sensor 36 for detecting toner content of the developer conveyed in the stirring chamber 34 is provided.

As shown in FIG. 4, a program executed by a central processing unit (CPU) of a controller 50 is received by a driver 52. The driver 52 drives a developing device motor M2 as a develop source for the developing sleeve 41 and a drum motor M1 as a develop source for the photosensitive drum 1*a*. The develop force of the developing device motor M2 is transmitted to the developing sleeve 41 by a coupling 54 and is further transmitted to the developing screw 43 and the stirring screw 44 via a gear mechanism 30 in the process cartridge 10*a*. The develop force of the drum motor M1 is transmitted to the photosensitive drum 1*a* by a coupling 53.

Incidentally, as a chronic trouble of the image forming apparatus 100, image defect such that a pitch-like stripe pattern and uneven image occurs with respect to a sub-scan direction (conveyance direction) has been conventionally known. This image defect is hereinafter referred to as pitch non-uniformity image.

The image defect referred to as the pitch non-uniformity image is generated by transmission of rotation non-uniformity or vibration of the gear mechanism 30 for the process cartridge 10*a* or the image forming apparatus 100 to the photosensitive drum 1*a* and then by writing (formation) of the image in a vibration state of the photosensitive drum 1*a*. Therefore, in the conventional image forming apparatus, the gear mechanism for driving the image bearing member and the gear mechanism for the charging roller or the cleaning device are provided independently of each other, so that the vibration of the gear mechanism for the image bearing member is prevented from transmitting to the other gear mechanism. Thus, a degree of the occurrence of the pitch non-uniformity image is reduced and a high image quality is obtained.

For example, in JP-A Hei 06-051576, separately from the gear mechanism for the developing device, the gear mechanism for the photosensitive drum is provided, so that the vibration of the gear mechanism generated by a fluctuation in load of the developing device is prevented from being transmitted to the photosensitive drum.

Further, in JP-A Hei 10-171331, in the process cartridge, the gear mechanisms for the charging roller, the developing device and the cleaning device are provided independently of each other, so that a degree of transmission of the vibration to the photosensitive drum is reduced.

However, the image defect (pitch non-uniformity image) is also generated by vibration of the exposure device 3 caused due to transmission of the vibration generated in the gear mechanism to a main assembly frame of the image forming apparatus 100 via the process cartridge 10*a*.

With respect to this problem, the methods proposed in JP-A Hei 06-051576 and JP-A Hei 10-171331 are not so effective. This is because an effect of suppressing the vibration of the process cartridge 10*a* itself is poor. Thus, such a problem that the vibration generation in each of the gear mechanisms is transmitted through the main assembly frame of the image forming apparatus to reach the exposure device has occurred.

In the following embodiments, the rotation non-uniformity and vibration in the gear mechanism for the developing device are confined in a supporting member by interposing a vibration damping member of a rubber material between a side wall and the developing container. In the process cartridge (developing device), the side wall at a side where the gear mechanism for the developing container is disposed is separately provided and is engaged with the developing container by a positioning means such as a boss causing less vibration transmission between the side wall and the developing container. As a result, the rotation non-uniformity and vibration in the gear mechanism for the developing device is prevented from being transmitted to the developing container of the developing device 4*a* and to the main assembly frame of the image forming apparatus 100.

Embodiment 1

Parts (a) and (b) of FIG. 5 are illustrations of a side member in this embodiment. FIG. 6 is an illustration of an assembling structure of the side member in this embodiment. FIG. 7 is an illustration of a gear structure. FIG. 8 is an illustration of a mounted structure of a front cover.

As shown in FIG. 5 with reference to FIG. 3, the gear mechanism 30 as a develop connection means in this embodiment interrelate the rotates of the developing sleeve 41 and the developer stirring members 43 and 44 at the outside of the developing container 40 with respect to the longitudinal direction. A side member 200 which is an example of the supporting member is supported by the developing container 40 via an elastic member 201 which is an example of a vibration damping member having a vibration transmission performance lower than that of the developing container 40. The side member 200 integrally supports the a developer feeding screw 48, the developing screw 43, the stirring screw 44 and the gear mechanism 30.

As shown in FIG. 6, the side member 200 also functions as a longitudinal end portion wall surface of the developing container 40, and the elastic member 201 also functions as a sealing member of a rubber material for sealing a gap between the developing container 40 and the side member 200 so as to prevent leakage of the developer from the gap.

As shown in FIG. 7, the gear mechanism 30 is disposed only at longitudinal one end side of the developing container 40. Further, as shown in FIG. 3, the developing container 40 is prepared by being integrally molded with an end portion wall surface, at the other end side thereof, for supporting the developing sleeve 41, the developing screw 43, the stirring screw 44 and a developer feeding screw 48.

As shown in FIG. 3, the first coupling 53 separably connects a rotation shaft of a first develop source M1 at the image forming apparatus main assembly side to a rotation shaft of the photosensitive drum 1*a* penetrated through the end portion wall surface at the other end side. The second coupling 54 separably connects a rotation shaft of a second develop source M2 at the image forming apparatus main assembly side to a rotation shaft of the developing sleeve 41 penetrated through the end portion wall surface at the other end side.

As shown in (a) of FIG. 5, the elastic member 201 is prepared by ejection molding performed so as to bury an elastic material of elastomer in a part of a resin material for the side member 200. The elastic member 201 is fixed to the side member 200, so that there is no need to worry about dropping as in the case of an O ring even when the elastic member 201 is handled during an assembling process. Thus, by interposing the elastic member 201 between the developing container 40 and the side member 200, it is possible to prevent leakage of the developer through the gap between the developing container 40 and the side member 200.

As shown in (a) of FIG. 5, the side member 200 is provided, as a positioning structure relative to the end portion of the developing container 40, with an engaging hole 200*a* and an engaging U-shaped groove 200*b*. On the other hand, as shown in FIG. 6, the developing container 40 is provided, as a positioning structure relative to the side member 201, with bosses 202*a* and 202*b*.

As shown in FIG. 6, the developing sleeve 41, the developing screw 43, the stirring screw 44 and the developer feeding screw 48 are mounted to the developing container 40 in advance. Then, by inserting the side member 200 provided with bearing members (not shown) for the respective rotatable members, relative positions of the developing sleeve 41, the developing screw 43, the stirring screw 44 and the developer feeding screw 48 are determined.

As shown in (b) of FIG. 5, the side member 200 is molded so that its central portion projects toward an inner space of the developing container 40. For this reason, when the side member 200 is mounted to the developing container 40, the side member 200 is guided by the central portion, so that the side member 200 is quickly positioned relative to the end portion of the developing container 40.

The side member 200 is assembled by engaging the positioning boss 202*a* of the developing container 40 with the engaging hole 200*a* of the side member 200 and by engaging the boss 202*b* with the engaging U-shaped groove 200*b*.

As shown in FIG. 7, in a state in which the side member 200 is mounted to the developing container 40, the gear mechanism 30 is assembled with the side member 200. A planar arrangement of respective gears will be described later in Embodiment 2 with reference to FIG. 12.

As shown in FIG. 8, a front cover 400 which is an example of a cover member is disposed outside the side member 200 so as to cover the gear mechanism 30. The front cover 400 also functions as a mounting member, for the side member 200, for urging the side member 200 in a direction in which the front cover 400 is locked by the developing container 40 and the elastic member 201 is compressed.

At a locking portion 40*p* of the process cartridge 10*a*, a hook 400*f* of the front cover 400 is locked, and the front cover 400 is fixed at three portions 400*n* with screws at the photosensitive drum side. The side member 200 and the elastic member 201 are sandwiched between the developing container 40 and the front cover 400 which is fixed in the above-described manner, thus being fixed while sealing the gap therebetween.

In the process cartridges 10*a*, 10*b*, 10*c* and 10*d* in this embodiment, the side member 200 provided with the gear mechanism 30 and the developing container 40 for supporting the side member 200 are prepared as separate parts. Further, by interposing the vibration damping member of the rubber material between the side member 200 and the developing container 40, the vibration generated in the gear mechanism is prevented from being transmitted to the photosensitive drum 1*a* and the developing container 40.

The side member 200 which holds the gear mechanism 30 is in a state in which the elastic member 201 is sandwiched between itself and the developing container 40, so that the vibration generation in the gear mechanism 30 is absorbed by the elastic member 201 and thus is little transmitted to the developing container 40. In this embodiment, the rotation non-uniformity and vibration of gears generated in the gear mechanism 30 are absorbed by the flexible vibration damping member to be prevented from being transmitted to the developing container 40, so that the vibration is prevented from reaching the exposure device 3.

As a result, it becomes possible to prevent the pitch non-uniformity image caused due to the vibration of the gear mechanism 30 for the process cartridges 10*a*, 10*b*, 10*c* and 10*d* or the developing devices 4*a*, 4*b*, 4*c* and 4*d*.

Further, in this embodiment, a developer feeding and stirring member 300 is, as shown in FIG. 6, mountable from one side direction of the process cartridge 10*a*, so that an assembling property can be improved. The developing container 40 and the side member 200 which constitutes a cap thereof are provided as separate members, so that the parts such as the developing screw 43 and the stirring screw 44 can be assembled linearly from the mounting side of the side member 200. For this reason, in the assembling by a manual operation, the assembling property and a checking property are improved.

Further, from the mounting side of the side member 200, all the parts can be assembled and fixed, so that it becomes possible to easily adapt the parts to an automatic assembling device.

Incidentally, the elastic member 201 may be formed of a material, such as a sealing material of a rubber type, a silicone-type or sponge-type, which has Young's modulus lower than that for the developing container 40. The elastic member 201 may also be mounted at the developing container 40 side.

Further, the positioning structure between the side member 200 and the developing container 40 is not limited to the boss engagement structure but may also be another positioning structure which is not the boss engagement structure.

Further, in this embodiment, the gear driving-side side wall of the developing container 40 is constituted by the side member 200 but the other side wall (opposite from the gear driving-side side wall) may be provided as a separate member. Thus, it is also possible to employ a constitution in which the longitudinal end members of the developing container are provided as separate members.

Further, as shown in FIG. 3, outside the developing container 40 having the longitudinal end portions where the respective rotatable members are sealed, the side member 200 provided with the gear mechanism 30 and the bearing members for the respective rotatable members may also be disposed. In this embodiment, the elastic member 201 is not required to seal the gap between the developing container 40 and the side member 200 so as to prevent the leakage of the developer and therefore there is no need to form the elastic member 201 in a closed-curve shape. The side member 200 may only be required to be supported via the elastic member 201 at a plurality of positions by the outer wall surface of the developing container 40.

Embodiment 2

FIG. 9 is an illustration of a planar structure of a developing device in this embodiment. Parts (a) and (b) of FIG. 10 are illustrations of a side member in this embodiment. FIG. 11 is an illustration of an assembling structure of the side member in this embodiment. FIG. 12 is an illustration of a planar arrangement of a gear structure.

As shown in FIG. 9, in this embodiment, compared with Embodiment 1, the side member is formed in a large size, so that the developing sleeve 41 and the photosensitive drum 1*a* are also integrally supported by the side member. With respect to the developing container 40 and the respective rotatable members, the same constitutions as those in Embodiment 1. Therefore, in FIGS. 9 to 12, constituent elements common to Embodiment 1 are represented by the same reference numerals or symbols and are omitted from redundant description.

As shown in (b) of FIG. 10, an elastic member 204 is mounted to a side member 203. The elastic member 204*a* is prepared by ejection molding of an elastic material of elastomer on the side member 203, i.e., by so-called hot-melt molding. The elastic member 204*a* is disposed to form a closed curve so as to surround the periphery of the developing chamber and the stirring chamber of the developing device 40. As a result, it is possible to prevent leakage of the developer through the gap between the developing container 40 and the side member 203. The developer leakage between the developing container 40 and the side member 203 can be prevented by interposing the elastic member 204*a* between the developing container 40 and the side member 203. Compared with Embodiment 1, added elastic members 204*b*, 204*c* and 204*d* are formed similarly as in the case of the elastic member 204*a* to alleviate the vibration transmission between the developing container 40 and the side member 203, so that the vibration generated at the side member 203 side is less transmitted to the developing container 40.

The elastic member 204*a* may be formed of a material, such as a sealing material of a rubber type, a silicone-type or sponge-type, which has Young's modulus lower than that for the developing container 40. The elastic member 201 may also be molded so as to be buried in a part of a resin material for the side member 204*a* prepared by injection molding of the silicone rubber.

The side member 203 is provided, as positioning boss engagement holes relative to the developing container 40, with an engaging hole 203*a*, an engaging U-shaped groove 203*b* and an engaging U-shaped groove 203*c*. On the other hand, as shown in FIG. 11, the developing container 40 is provided with bosses 202*a* and 202*b*. The side member 203 is assembled by engaging the positioning boss 202*a* of the developing container 40 with the engaging hole 203*a* of the side member 203 and by engaging the boss 202*b* with the engaging U-shaped groove 203*b*.

As shown in FIG. 11, the side member 203 is assembled at the end portion of the developing container 40, so that the developing sleeve 41, the developing screw 43, the stirring screw 44 and the developer feeding screw 48 are positioned. FIG. 11 shows an assembling state of the side member 203 with the developing container 40. After the gear mechanism 30 is assembled as shown in FIG. 7, the side member 203 is sandwiched and fixed between the developing container 40 and a front cover 400 by fixing the front cover 400 to the side member 203 as shown in FIG. 8.

As shown in FIG. 12, after the side member 203 is assembled with the developing container 40, the gear mechanism 30 is assembled with the side member 203. By the side member 203, relative positions among the developing screw 43, the stirring screw 44, the developer feeding screw 48 and the photosensitive drum 1*a* are determined. The side member 203 is mounted to the developing container 40 to hold the gear mechanism 30 and the photosensitive drum 1*a*. A gear 41*g* is rotated by inputting the driving force from the developing device motor M2 shown in FIG. 9 to the developing sleeve 41. The rotation of the gear 41*g* is distributed, via an idler gear 31*g* as a connecting gear, into a gear 43*g* for the developing screw 43 and a gear 44*g* for the stirring screw 44. Further, via another idler gear 32*g* as the connecting roller, the rotational force is transmitted to a gear 48*g* for the developer feeding screw 48.

With the respect to the idler gears 31*g* and 32*g*, as shown in FIG. 11, rotation shafts 31*j* and 32*j* are fixed on the side member 203 and therefore engagement vibration of each of the idler gears 31*g* and 32*g* directly vibrates the side member 203. In addition to the engagement vibration, a radial force acting on each of the rotation shafts 31*j* and 32*j* is fluctuated at a certain period by eccentric rotation of each of the gears 43*g*, 44*g* and 48*g*, so that the side member 203 is vibrated. A load fluctuation of each of the developing screw 43 and the stirring screw 44 also causes the vibration of the side member 203 through an unshown bearing member.

When a coupling (complex) vibration of these factors is transmitted to the developing container 40 as it is, the vibration is transmitted from the developing container 40 to the main assembly casing of the image forming apparatus 100, so that the exposure device 3 is vibrated. When the exposure device 3 is vibrated, even when the light source of the laser beam causes a slight angular fluctuation, a beam spot position largely fluctuates on the photosensitive drum 1*a*, so that the pitch non-uniformity of the scanning lines is conspicuous on the outputted image.

In this embodiment, the side member 203 which holds the gear mechanism 30 and the photosensitive drum 1*a* is in a state in which the elastic member 204 is sandwiched between itself and the developing container 40, so that the gear vibration generation in the gear mechanism 30 is absorbed by the elastic member 204 and thus is little transmitted to the developing container 40. As a result, it becomes possible to prevent the pitch non-uniformity image caused due to the process cartridges 10*a*, 10*b*, 10*c* and 10*d* or the gear mechanism 30.

Further, also in this embodiment, the respective rotatable members assembled with the developing container 40 are mountable from one side direction of the developing container 40, so that an assembling property can be improved.

Further, also in Embodiment 2, it is also possible to employ a constitution in which the side member 203 is provided at each of the longitudinal end portions of the developing container 40 and is provided as a separate member from the developing container 40. The elastic member 204 may also be mounted at the developing container 40 side.

In the process cartridge of the present invention, the vibration damping member is disposed between the supporting member and the developing container and therefore the vibration generated in the gear mechanism for the developing device is confined in the supporting member and thus is not transmitted to the developing container. As a result, the vibration transmitted from the developing device to the casing structure of the image forming apparatus is suppressed without relying on the casing structure or the mounting structure, so that the scanning line pitch non-uniformity of the outputted image can be reduced.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 146198/2010 filed Jun. 28, 2010, which is hereby incorporated by reference.

What is claimed is:

1. A process cartridge detachably mountable to a main assembly of an image forming apparatus, said process cartridge comprising:

an image bearing member;

a developer carrying member for developing an electrostatic image on said image bearing member;

a first gear provided on said developer carrying member;

a second gear drivingly-connected to said first gear;

a first cartridge frame for rotatably supporting said image bearing member, wherein said first cartridge frame includes an accommodating portion for accommodating a developer to be supplied to said developer carrying member;

a second cartridge frame, mounting on said first cartridge frame, for rotatably supporting said second gear and for forming a part of a wall of the accommodating portion; and a rubber member for sealing between said first cartridge frame and said second cartridge frame and for reducing a degree of vibration transmission between said first cartridge frame and said second cartridge frame.

2. A process cartridge according to claim 1, wherein said second gear rotates around a fixed shaft fixed at said second cartridge frame.

3. A process cartridge according to claim 1, wherein said second cartridge frame is mounted on an image bearing member supporting portion, for rotatably supporting said image bearing member, through at least said rubber member.

4. A process cartridge according to claim 1, further comprising:

a stirring member for stirring the developer in said accommodating portion, wherein said second gear transmits a driving force from said developer carrying member to said stirring member.

5. A process cartridge according to claim 4, wherein said second cartridge frame includes a pair of bearing portions for bearing a rotation shaft provided at said developer carrying member at one end side of said developer carrying member and a rotation shaft provided at said developer carrying member at the other end side of side of said developer carrying member, and a bearing for bearing a rotation shaft of said stirring member.

6. A process cartridge according to claim 1, further comprising:

a supporting member for supporting said second cartridge frame in a direction in which said rubber member is compressed, wherein said supporting member includes a hook portion to be locked at a locking portion provided on said first cartridge frame, and wherein said second cartridge frame is capable of being positioned with respect to an axial direction of said developer carrying member by locking said hook portion.

7. A process cartridge according to claim 6, wherein said supporting member also functions as a cover portion for covering said second gear.

8. A process cartridge according to claim 1, further comprising:

a first coupling for separably connecting a rotation shaft of a first driving source at a main assembly side of the image forming apparatus to a rotation shaft of said image bearing member; and a second coupling for separably connecting a rotation shaft of a second driving source at the main assembly side of the image forming apparatus to a rotation shaft provided at said developer carrying member.

9. A process cartridge according to claim 1, wherein said rubber member is partly provided at a position of an inner surface of said second cartridge frame corresponding to a connecting position with said process cartridge, and said rubber member is disposed to form a closed curve so as to correspond to the connecting position.

10. A cartridge detachably mountable to a main assembly of an image forming apparatus, said cartridge comprising:

a developer carrying member for developing an electrostatic image;

an accommodating portion for accommodating a developer to be supplied to said developer carrying member;

a first feeding member for feeding the developer contained in said accommodating portion;

a second feeding member for feeding the developer contained in said accommodating portion;

a first gear attached to said first feeding member in one end side;

a second gear attached to said second feeding member in said one end side;

a first cartridge frame portion, including a pair of bearings for rotatably supporting end portions of said developer carrying member, for accommodating therein said first feeding member and said second feeding member and for forming a part of an inner wall of said accommodating portion;

a second cartridge frame portion forming a part of said accommodating portion, said second cartridge frame including a first bearing portion for rotatably supporting said first feeding member in said one end side and a second bearing portion for rotatably supporting said second feeding member in said one end side;

an elastic member sandwiched between said first and second cartridge frame portions; and an engaging portion configured to be engaged with said first cartridge frame portion so as to compress said elastic member between said first cartridge frame portion and said second cartridge frame portion.

11. A cartridge according to claim 10, wherein said second cartridge frame portion is provided with a shaft for rotatably supporting a gear engaged with said plurality of gears.

12. A cartridge according to claim 10, wherein said elastic member also functions as a seal member for sealing between said first and second cartridge frame portions.

13. A cartridge according to claim 10, wherein said first cartridge frame portion includes a third bearing portion for rotatably supporting said first feeding member in the other end side and includes a fourth bearing portion for rotatably supporting said second feeding member in the other end side.

14. A cartridge according to claim 10, wherein said elastic member is a rubber member.

15. A cartridge according to claim 10, further comprising a cover member for covering said first gear and said second gear, wherein said engaging portion is provided on said cover member, and when said cover member is locked on said first cartridge frame portion by said engaging portion, said cover member is constituted so that said cover member urges said second cartridge frame portion toward said first cartridge frame portion to compress said elastic member between said first cartridge frame portion and said second cartridge frame portion.

16. A cartridge according to claim 10, wherein said first and second cartridge frame portions are provided with a plurality of projections and a plurality of engaging holes for being positioned relative to each other.

17. A cartridge according to claim 10, further comprising a supporting portion for supporting said second cartridge frame portion, wherein said engaging portion is constituted integrally with said supporting portion.

18. A cartridge according to claim 10, wherein said second cartridge frame portion includes a projected portion projecting toward an inner space of said first cartridge frame portion, and said projected portion is a guiding portion for guiding said second cartridge frame portion toward said first cartridge frame portion.

19. A cartridge according to claim 10, wherein said engaging portion includes a hook portion to be locked at a locking portion provided on said first cartridge frame portion, and wherein said second cartridge frame portion is capable of being positioned with respect to an axial direction of said developer carrying member by locking said hook portion.

20. A cartridge according to claim 10, further comprising a coupling for separably connecting a rotation shaft of a driving source at the main assembly side of the image forming apparatus to a rotation shaft of said developer carrying member.

21. A cartridge detachably mountable to a main assembly of an image forming apparatus, said cartridge comprising:

an image bearing member for bearing an image;

a developer carrying member for developing an electrostatic image on said image bearing member;

an accommodating portion for accommodating a developer to be supplied to said developer carrying member;

a first feeding member for feeding the developer contained in said accommodating portion;

a second feeding member for feeding the developer contained in said accommodating portion;

a first gear attached to said first feeding member in one end side;

a second gear attached to said second feeding member in said one end side; a first cartridge frame forming a part of said accommodating portion, said first cartridge frame including a pair of first bearing portions for rotatably supporting said image bearing member at end portions;

a second cartridge frame forming a part of said accommodating portion, said second cartridge frame including a first bearing portion for rotatably supporting said first feeding member in said one end side and a second bearing portion for rotatably supporting said second feeding member in said one end side; and an elastic member sandwiched between said first and second cartridge frames.

22. A cartridge according to claim 21, wherein said second cartridge frame is provided with a shaft for rotatably supporting a gear engaged with said plurality of gears.

23. A cartridge according to claim 21, wherein said elastic member also functions as a seal member for sealing between said first and second cartridge frames.

24. A cartridge according to claim 21, wherein said accommodating portion includes (i) a first chamber for feeding the developer to said developer carrying member, (ii) a second chamber connected with said first chamber at end portions of said first chamber for forming a circulation path with said first chamber, and (iii) a partition wall for partitioning said first and second chambers from each other.

25. A cartridge according to claim 24, wherein said first feeding member feeds the developer contained in said first chamber, and said second feeding member feeds the developer contained in said second chamber.

26. A cartridge according to claim 25, wherein said first cartridge frame portion includes a third bearing portion for rotatably supporting said first feeding member in the other end side and includes a fourth bearing portion for rotatably supporting said second feeding member in the other end side.

27. A cartridge according to claim 21, wherein said elastic member is a rubber member.

28. A cartridge according to claim 21, further comprising an engaging portion configured to engage with said first cartridge frame so as to compress said elastic member between said first cartridge frame and said second cartridge frame.

29. A cartridge according to claim 28, wherein said engaging portion also functions as a cover member for covering said first gear and said second gear.

30. A cartridge according to claim 28, wherein said engaging portion includes a supporting portion for supporting said second cartridge frame.

31. A cartridge according to claim 21, wherein said first and second cartridge frames are provided with a plurality of projections and a plurality of engaging holes for being positioned relative to each other.

32. A cartridge according to claim 21, wherein said second cartridge frame includes a projected portion projecting toward an inner space of said first cartridge frame, and said projected portion is a guiding portion for guiding said second cartridge frame toward said first cartridge frame.

33. A cartridge according to claim 21, wherein said engaging portion includes a hook portion to be locked at a locking portion provided on said first cartridge frame, and wherein said second cartridge frame is capable of being positioned with respect to an axial direction of said developer carrying member by locking said hook portion.

34. A cartridge according to claim 21, further comprising:

a first coupling for separably connecting a rotation shaft of a first driving source at the main assembly side of the image forming apparatus to a rotation shaft of said image bearing member; and a second coupling for separably connecting a rotation shaft of a second driving source at the main assembly side of the image forming apparatus to a rotation shaft of said developer carrying member.

35. A cartridge detachably mountable to a main assembly of an image forming apparatus, said cartridge comprising:

a developer carrying member for developing an electrostatic image;

an accommodating portion for accommodating a developer to be supplied to said developer carrying member;

a first feeding member for feeding the developer contained in said accommodating portion;

a second feeding member for feeding the developer contained in said accommodating portion;

a first gear attached to said first feeding member in one end side;

a second gear attached to said second feeding member in said one end side;

a first cartridge frame, including a pair of bearings for rotatably supporting end portions of said developer carrying member, for accommodating therein said first feeding member and said second feeding member and for forming a part of an inner wall of said accommodating portion;

a second cartridge frame forming a part of said accommodating portion, said second cartridge frame including a first bearing portion for rotatably supporting said first feeding member in said one end side and a second bearing portion for rotatably supporting said second feeding member in said one end side;

an elastic member sandwiched between said first and second cartridge frames, wherein said second cartridge frame is attached to said first cartridge frame via said elastic member without being directly fastened to said first cartridge frame.

36. A cartridge according to claim 35, wherein said accommodating portion includes (i) a first chamber for feeding the developer to said developer carrying member, (ii) a second chamber connected with said first chamber at end portions of said first chamber for forming a circulation path with said first chamber, and (iii) a partition wall for partitioning said first and second chambers from each other.

37. A cartridge according to claim 36, wherein said first feeding member feeds the developer contained in said first chamber and said second feeding member feeds the developer contained in said second chamber.

38. A cartridge according to claim 35, wherein said first and second cartridge frames are provided with a plurality of projections and a plurality of engaging holes for being positioned relative to each other.

39. A cartridge according to claim 35, further comprising a supporting member for supporting said second cartridge frame so as to compress said elastic member between said first cartridge frame and said second cartridge frame.

40. A cartridge detachably mountable to a main assembly of an image forming apparatus, said cartridge comprising:

a developer carrying member for developing an electrostatic image;

an accommodating portion for accommodating a developer to be supplied to said developer carrying member;

a first feeding member for feeding the developer contained in said accommodating portion;

a second feeding member for feeding the developer contained in said accommodating portion;

a first gear attached to said first feeding member in one end side;

a second gear attached to said second feeding member in said one end side;

a first cartridge frame, including a pair of bearings for rotatably supporting end portions of said developer carrying member, for accommodating therein said first feeding member and said second feeding member and for forming a part of an inner wall of said accommodating portion;

a second cartridge frame forming a part of said accommodating portion, said second cartridge frame including a first bearing portion for rotatably supporting said first feeding member in said one end side and a second bearing portion for rotatably supporting said second feeding member in said one end side; and a rubber member for sealing between said first cartridge frame and said second cartridge frame and for reducing a degree of vibration transmission between said first cartridge frame and said second cartridge frame.

41. A cartridge detachably mountable to a main assembly of an image forming apparatus, said cartridge comprising:

a developer carrying member for developing an electrostatic image;

an accommodating portion for accommodating a developer to be supplied to said developer carrying member;

a first feeding member for feeding the developer contained in said accommodating portion;

a second feeding member for feeding the developer contained in said accommodating portion;

a first gear attached to said first feeding member in one end side;

a second gear attached to said second feeding member in said one end side; a first cartridge frame, including a pair of bearings for rotatably supporting end portions of said developer carrying member, for accommodating therein said first feeding member and said second feeding member and for forming a part of an inner wall of said accommodating portion;

a second cartridge frame forming a part of said accommodating portion, said second cartridge frame including a first bearing portion for rotatably supporting said first feeding member in said one end side and a second bearing portion for rotatably supporting said second feeding member in said one end side;

an elastic member sandwiched between said first and second cartridge frames; and a cover member, including an engaging portion configured to engage with said first cartridge frame, for covering said first gear and said second gear, wherein, when said cover member is locked on said first cartridge frame, said cover member is constituted so that said cover member urges said second cartridge frame toward said first cartridge frame to compress said elastic member between said first cartridge frame and said second cartridge frame.

42. A cartridge detachably mountable to a main assembly of an image forming apparatus, said cartridge comprising:

a developer carrying member for developing an electrostatic image;

an accommodating portion for accommodating a developer to be supplied to said developer carrying member;

a first feeding member for feeding the developer contained in said accommodating portion;

a second feeding member for feeding the developer contained in said accommodating portion;

a first gear attached to said first feeding member in one end side;

a second gear attached to said second feeding member in said one end side;

a first frame, including a pair of bearings for rotatably supporting end portions of said developer carrying member, for accommodating therein said first feeding member and said second feeding member and for forming a part of an inner wall of said accommodating portion;

a second frame forming a part of said accommodating portion, said second cartridge frame including a first bearing portion for rotatably supporting said first feeding member in said one end side and a second bearing portion for rotatably supporting said second feeding member in said one end side; and an elastic member sandwiched between said first and second cartridge frames, wherein said second frame is engaged and assembled with said first frame and is attached to said first frame via said elastic member.

43. A cartridge detachably mountable to a main assembly of an image forming apparatus, said cartridge comprising:

a developer carrying member configured to develop an electrostatic image;

an accommodating portion configured to accommodate a developer to be supplied to said developer carrying member;

a first feeding member configured to feed the developer contained in said accommodating portion;

a second feeding member configured to feed the developer contained in said accommodating portion;

a first gear attached to said first feeding member in one end side;

a second gear attached to said second feeding member in said one end side;

a first frame, including a pair of bearings configured to rotatably support end portions of said developer carrying member, configured to accommodate therein said first feeding member and said second feeding member and configured to form a part of an inner wall of said accommodating portion;

a second frame configured to form a part of said accommodating portion, said second frame including a first bearing portion configured to rotatably support said first feeding member in said one end side and a second bearing portion configured to rotatably support said second feeding member in said one end side;

an elastic member sandwiched between said first and second frames; and an urging member, mounted on said first frame, configured to urge said elastic member toward said first frame through said second frame.

44. A cartridge according to claim 43, wherein said urging member includes a hook portion configured to be hooked on said first frame.

45. A cartridge according to claim 43, wherein said second frame is attached to said first frame via said elastic member without being directly fastened to said first frame.

46. A cartridge according to claim 43, wherein said elastic member is a rubber member configured to seal between said first frame and said second frame and configured to reduce a degree of vibration transmission between said first frame and said second frame.

47. A cartridge according to claim 43, wherein said first and second frames are provided with a plurality of projections and a plurality of engaging holes for being positioned relative to each other.

48. A cartridge according to claim 43, wherein said urging member is a cover member for covering said first gear and said second gear.

49. A cartridge according to claim 43, wherein said accommodating portion includes (i) a first chamber for feeding the developer to said developer carrying member, (ii) a second chamber connected with said first chamber at end portions of said first chamber for forming a circulation path with said first chamber, and (iii) a partition wall for partitioning said first and second chambers from each other.

50. A cartridge according to claim 49, wherein said first feeding member feeds the developer contained in said first chamber and said second feeding member feeds the developer contained in said second chamber.

51. A cartridge detachably mountable to a main assembly of an image forming apparatus, said cartridge comprising:

a developer carrying member configured to develop an electrostatic image;

an accommodating portion configured to accommodate a developer to be supplied to said developer carrying member;

a feeding member configured to feed the developer contained in said accommodating portion;

a gear attached to said feeding member in one end side;

a first frame, including a pair of bearings configured to rotatably support end portions of said developer carrying member, configured to accommodate therein said feeding member and configured to form a part of an inner wall of said accommodating portion;

a second frame configured to form a part of said accommodating portion, said second frame including a first bearing portion configured to rotatably support said feeding member in said one end side;

an elastic member sandwiched between said first and second frames; and a press member, mounted on said first frame, configured to press said elastic member toward said first frame through said second frame.

52. A cartridge according to claim 51, wherein said press member includes a hook portion configured to be hooked on said first frame and, when said hook portion is hooked on said first frame, said press member is constituted so that said press member presses said second frame toward said first frame to compress said elastic member between said first frame and said second frame.

53. A cartridge detachably mountable to a main assembly of an image forming apparatus, said cartridge comprising:

a developer carrying member configured to develop an electrostatic image;

an accommodating portion configured to accommodate a developer to be supplied to said developer carrying member;

a feeding member configured to feed the developer contained in said accommodating portion;

a gear attached to said feeding member in one end side;

a first frame, including a pair of bearings configured to rotatably support end portions of said developer carrying member, configured to accommodate therein said feeding member and configured to form a part of an inner wall of said accommodating portion;

a second frame configured to form a part of said accommodating portion, said second frame including a first bearing portion configured to rotatably support said feeding member in said one end side; and an elastic member sandwiched between said first and second frames, wherein said second frame is mounted to said first frame through said elastic member without being fixed with a screw.

54. A cartridge according to claim 53, wherein said second frame is engaged with said first frame and is attached to said first frame via said elastic member.

55. A cartridge according to claim 53, wherein said second frame is fitted onto said first frame.

56. A cartridge detachably mountable to a main assembly of an image forming apparatus, said cartridge comprising:

a developer carrying member configured to develop an electrostatic image;

an accommodating portion configured to accommodate a developer to be supplied to said developer carrying member;

a first feeding member configured to feed the developer contained in said accommodating portion;

a second feeding member configured to feed the developer contained in said accommodating portion;

a first gear attached to said first feeding member in one end side;

a second gear attached to said second feeding member in said one end side;

a first frame, including a pair of bearings configured to rotatably support end portions of said developer carrying member, configured to accommodate therein said first feeding member and said second feeding member, and configured to form a part of an inner wall of said accommodating portion;

a second frame configured to form a part of said accommodating portion, said second frame including a first bearing portion configured to rotatably support said first feeding member in said one end side and a second bearing portion configured to rotatably support said second feeding member in said one end side;

an elastic member sandwiched between said first and second frames; and a press member, mounted on said first frame, configured to press said elastic member toward said first frame through said second frame.

57. A cartridge detachably mountable to a main assembly of an image forming apparatus, said cartridge comprising:

a developer carrying member configured to develop an electrostatic image;

an accommodating portion configured to accommodate a developer to be supplied to said developer carrying member;

a first feeding member configured to feed the developer contained in said accommodating portion;

a second feeding member configured to feed the developer contained in said accommodating portion;

a first gear attached to said first feeding member in one end side;

a second gear attached to said second feeding member in said one end side;

a first frame, including a pair of bearings configured to rotatably support end portions of said developer carrying member, configured to accommodate therein said first feeding member and said second feeding member and configured to form a part of an inner wall of said accommodating portion;

a second frame configured to form a part of said accommodating portion, said second frame including a first bearing portion configured to rotatably support said first feeding member in said one end side and a second bearing portion configured to rotatably support said second feeding member in said one end side; and an elastic member sandwiched between said first and second frames, wherein said second frame is mounted to said first frame through said elastic member without being fixed with a screw.

58. A cartridge detachably mountable to a main assembly of an image forming apparatus, said cartridge comprising:

a developer carrying member configured to develop an electrostatic image;

an accommodating portion configured to accommodate a developer to be supplied to said developer carrying member;

a feeding member configured to feed the developer contained in said accommodating portion;

a gear attached to said feeding member in one end side;

a first frame portion, including a pair of bearings configured to rotatably support end portions of said developer carrying member, configured to accommodate therein said feeding member, and configured to form a part of an inner wall of said accommodating portion;

a second frame portion configured to form a part of said accommodating portion, said second frame including a first bearing portion configured to rotatably support said feeding member in said one end side;

an elastic member sandwiched between said first frame portion and said second frame portion; and a hook portion configured to be hooked on said first frame so as to compress said elastic member between said first frame portion and said second frame portion.

* * * * *